United States Patent [19]

Pankin et al.

[11] 3,952,430

[45] Apr. 27, 1976

[54] SHOE CONSTRUCTION

[75] Inventors: Jerome Pankin, New York, N.Y.; Beverly Ann Feldman, Albufera, Spain

[73] Assignee: Pankin International, Ltd., New York, N.Y.

[22] Filed: Oct. 29, 1975

[21] Appl. No.: 626,751

Related U.S. Application Data

[63] Continuation of Ser. No. 569,284, April 18, 1974, Pat. No. 3,916,539.

[52] U.S. Cl. ..... 36/51

[51] Int. Cl.[2] ..... A43B 11/00

[58] Field of Search ..... 36/51, 50, 54, 2.5 R

[56] References Cited

UNITED STATES PATENTS

| | | | |
|---|---|---|---|
| 1,841 | 10/1840 | Dupont et al. | 36/51 |
| 970,444 | 9/1910 | Helbig | 36/51 |
| 1,940,542 | 12/1933 | Goth | 36/51 |
| 2,094,091 | 9/1937 | Bancroft | 36/51 |
| 2,140,302 | 12/1938 | Roberts | 36/51 |
| 2,184,082 | 12/1939 | Roberts | 36/51 |
| 2,205,577 | 6/1940 | Roberts | 36/51 |
| 2,241,440 | 5/1941 | Bancroft | 36/51 |
| 2,361,675 | 10/1944 | Atkins | 36/51 |
| 3,037,303 | 6/1962 | Stever | 36/51 |
| 3,533,172 | 10/1970 | Jones | 36/51 |

FOREIGN PATENTS OR APPLICATIONS

| | | | |
|---|---|---|---|
| 689,540 | 5/1930 | France | 36/51 |
| 1,471,601 | 1/1967 | France | 36/51 |

*Primary Examiner*—Patrick D. Lawson
*Attorney, Agent, or Firm*—Gottlieb, Rackman, Reisman & Kirsch

[57] ABSTRACT

A shoe construction in which an elastic gore is stitched to and runs from one side of the vamp to the other side across the throat of the shoe. The elastic gore is sandwiched between the tongue and the shoe lining, thereby hiding the gore from view, and preventing it from contacting the foot of the wearer. The gore, when contracted, shirrs the mid-section of the tongue.

9 Claims, 5 Drawing Figures

SHOE CONSTRUCTION

This application is a continuation of Ser. No. 569,284, filed Apr. 18, 1974, now U.S. Pat. No. 3,916,539.

The present invention relates to the construction of a shoe, and more particularly to the construction of the vamp and tongue area of a shoe, by utilizing an elastic gore.

It is the primary object of the present invention to provide in a shoe construction, an elastic gore bridging the throat of the shoe, while being hidden from view and being out-of-contact with a foot placed into the shoe.

It is another object of the present invention to provide in a shoe construction of the type described, an elastic gore which when in a relaxed or unstretched mode, shirrs the central portion of the tongue member of the shoe.

It is another object of the present invention to provide a shoe construction of the type described, which, by virtue of an elastic gore bridging the vamp of the shoe, is able to properly accommodate feet of various widths comfortably, and which can readily expand and conform to the natural swelling of a wearer's foot, as might take place after several hours of wear.

It is another object of the present invention to provide a shoe construction of the type described, which by virtue of its elastic gore construction, eliminates any need for the use of buckles or shoelaces to properly "fit" the shoe to the foot of a wearer, and is pleasant in appearance and to wear, even after considerable use.

In general, the new shoe construction of the present invention relates to an elastic gore which traverses the throat area of the shoe, being stitched to and running from one side of the vamp to the other. The gore is contained in a tunnel formed on the exterior side by a tongue member and on the interior side by a lining member, which is stitched and sewn to the tongue member. Both the tongue member and the lining member have pairs of opposed tabs, which cover the ends of the gore, and which are stitched to the gore and the vamp to retain the gore in place. Further, the gore is glued to the tongue member and the lining member. Thereby, the gore when "relaxed", shirrs the tongue member, and when stretched, the tongue member is essentially smooth.

Referring now in detail to the drawings.

Figure 1:
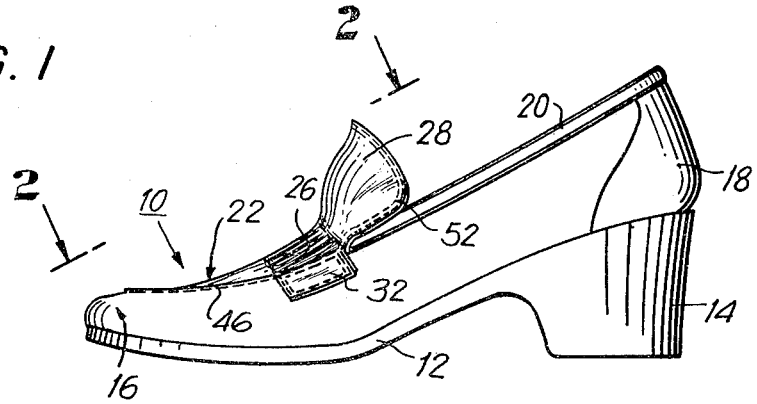
FIG. 1 is a side elevational view of a shoe, including the new shoe construction.
Figure 2:
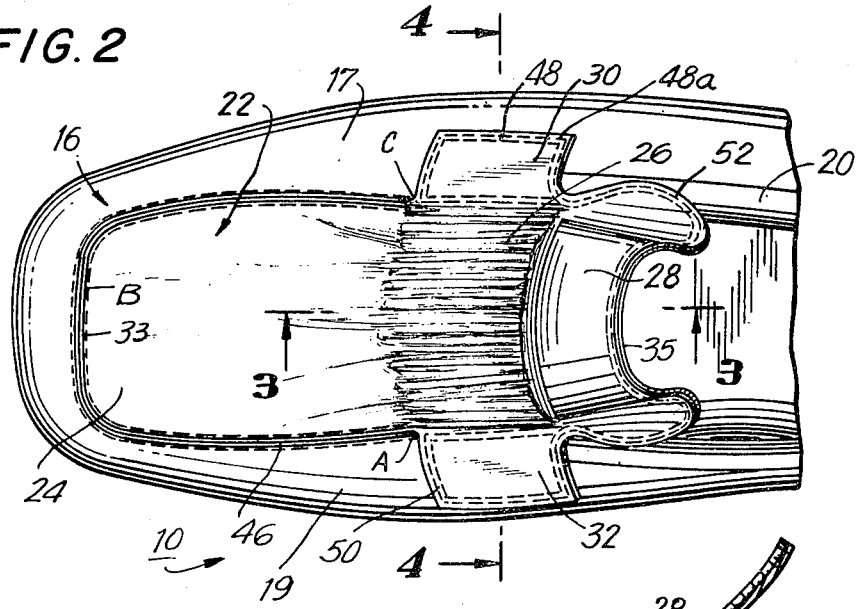
FIG. 2 is a fragmentary top plan view of the shoe including the new shoe construction, taken substantially along the line 2—2 of FIG. 1.
Figure 3:
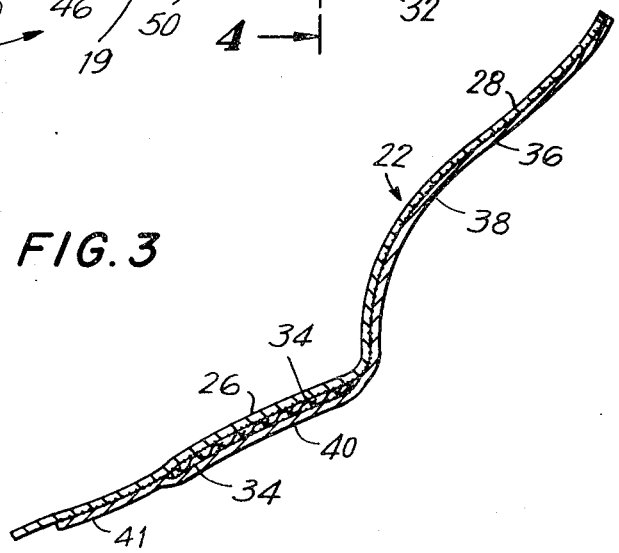
FIG. 3 is a cross sectional view of the new shoe construction, taken substantially along the line 3—3 of FIG. 2.
Figure 4:
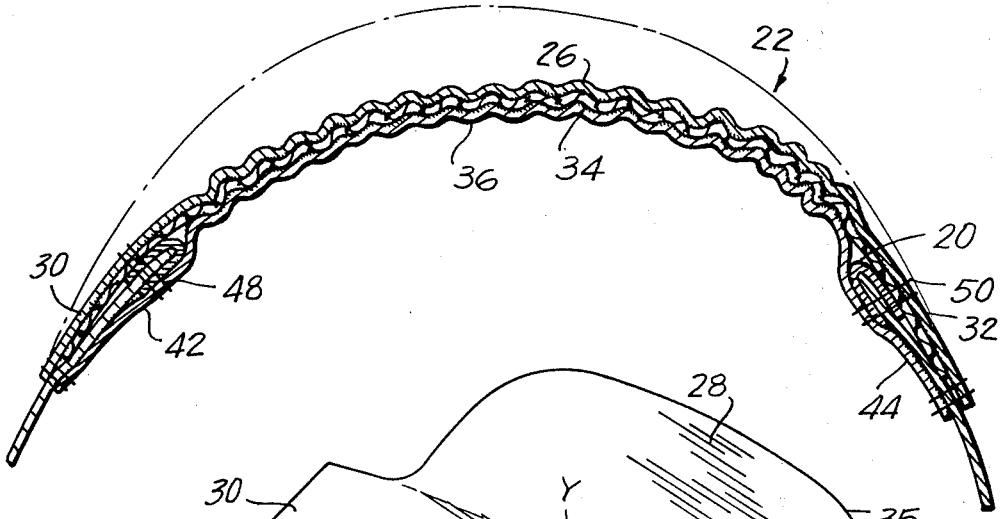
FIG. 4 is an enlarged transverse cross-sectional view of the new shoe construction, taken substantially along the line 4—4 of FIG. 2.

A shoe, incorporating the new shoe construction of the present invention, is shown in FIGS. 1 and 2. The shoe 10 which is illustrated is styled to be worn by a woman, but a shoe including the new construction, could as well be styled for men or for children. Desirably, the shoe is constructed of a glove-quality leather, but other leathers or other synthetic materials may be employed. Glove-quality leather is very soft, making the shoe very comfortable to wear. Further, desirably, the shoe has no lining, except to the extent hereafter mentioned, again making it very comfortable to wear.

The shoe 10 includes a sole 12 and a heel 14, which are conventional. The shoe further includes a vamp 16, a fox 18, and an encircling collar 20. The vamp 16, which includes a right side vamp section 17 and a left side vamp section 19, the fox 18 and the collar 20 are joined to one another and to the sole 12 and heel 14, by stitching and gluing, as is also conventional in the construction of shoes.

Figure 5:
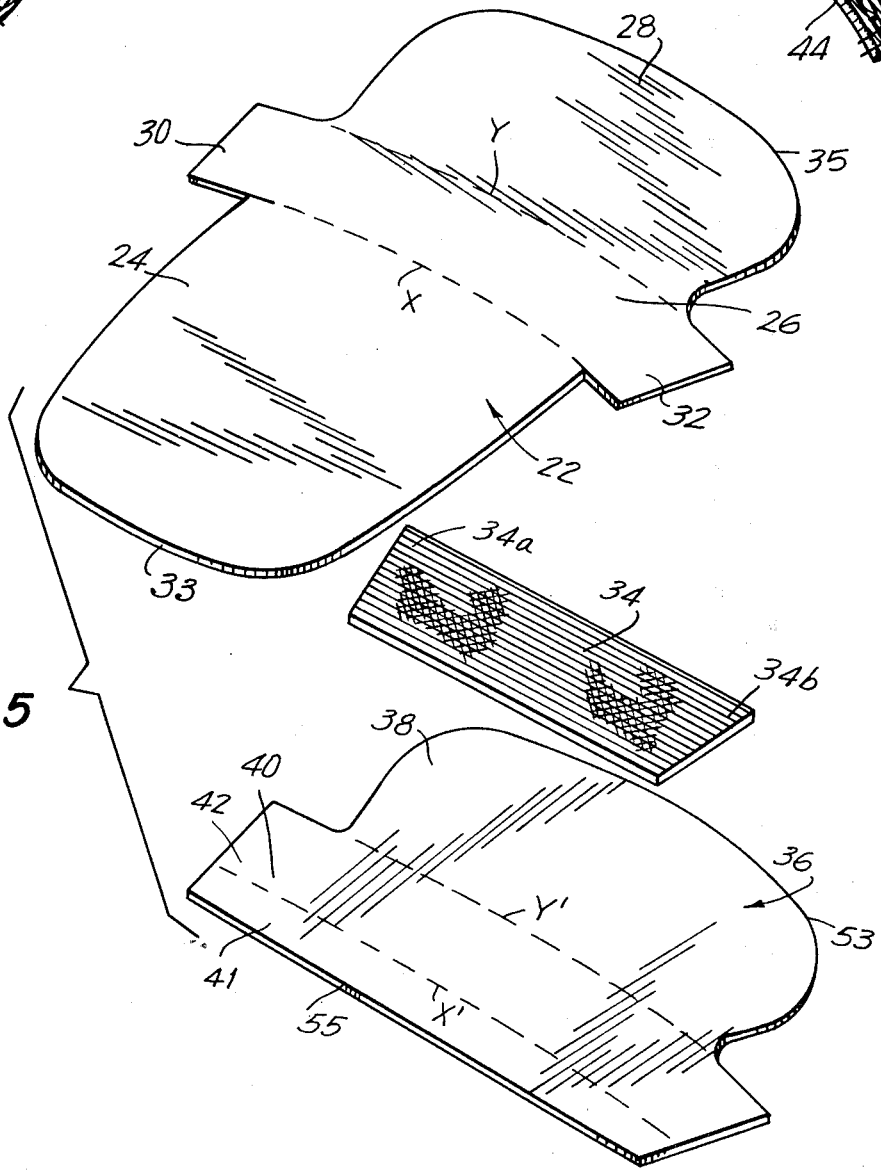
FIG. 5 is an exploded view of the three components of the new shoe construction.

The new shoe construction of the present invention is shown in detail in FIGS. 2, 3, 4 and 5. The shoe construction includes a tongue member 22, with a moccasin or front section 24, a throat or middle section 26 and a rear or flaired section 28. Desirably, the sections 24, 26 and 28 are formed integrally of one piece of continuous material, which has no openings or interruptions in it. As seen in FIG. 5, the sections 24, 26 and 28 are bounded by dotted lines X, Y, which are shown for the purpose of explanation only.

The throat section 26 has a pair of opposed, protruding somewhat rectangular tabs on its ends, and specifically, as seen in FIG. 5, a right-side tab 30 and a left-side tab 32, the tabs being mirror images of one another and projecting co-equally beyond the side edges of the moccasin section 24 and the flaired section 28.

The forward edge 33 of the moccasin section 24 is somewhat rounded, and the tongue member as a whole becomes wider, progressing from the forward edge 33 to the rearward edge 35 of the flaired section 28. The rearward edge 35 is also rounded. However, the specific configuration of the tongue member 22 will necessarily vary in accordance with the particular styling of the shoe in which it is used.

Another component of the new shoe construction comprises an elastic strip or gore 34. The gore is desirably formed of conventional elastic tape, but may be made of any other stretchable material, such as rubber. The gore has a configuration substantially similar to the configuration of the throat section 26, but its length when unstretched, is less than the length of the throat section, running from the outside edge of the tab 30 to the outside edge of the tab 32. Desirably, the gore has a right-side portion **34*a* having an outside edge generally parallel to the edge of the tab 30, and has a left-side portion 34*b*, with an outside edge generally parallel to the edge of the tab 32**.

The final component of the new shoe construction is the lining member 36 which includes a tongue lining section 38 and a throat lining section 40. The tongue lining section 38 has a configuration, after the usual trimming, which is substantially identical to the configuration of the flaired section 28, and the throat lining section 40 has a configuration, after trimming, which is substantially identical to the configuration of the throat section 26. The throat lining section 40 has a small extension 41. The throat lining section 40 includes a pair of somewhat rectangular tabs, and specifically a right-side tab 42 and a left-side tab 44, which, after trimming, match the tabs 30, 32 of the tongue member 22.

Having described the components of the new shoe construction, their assembly into a shoe will now be discussed.

The tongue member 22, the elastic gore 34 and the lining member 36 form a sandwich, with the tongue member 22 being the topmost or outermost member, as seen in FIGS. 1 and 2, with elastic gore 34 being the intermediate member, and the lining member 36 being the bottom or inward-most component. The periphery of the tongue member 22 at the moccasin section 24 is joined to the inner edge of the vamp 16 by conventional means as by stitching, running along a line of stitching 46, from point A in FIG. 2 through point B in FIG. 2 to point C in FIG. 2. Other joining means, such as gluing, may be utilized in appropriate circumstances.

The gore 34 is stretched and when so stretched, is glued to the reverse or innerside of the tongue member at the throat section 26. The reverse face of lining member 36 is then glued to the inner face of tongue member 22 and gore 34.

The throat section 26 of the tongue member 22 is then stitched so that it is joined through the elastic gore 34 to the vamp 16 and to the throat lining section 40 of the lining member 36. More specifically, as best seen in FIG. 2, two parallel, rectangular lines of stitching 48 generally follow the configuration of the edges of the tab 30, and in so doing, pass first through the aligned end portion of the elastic gore 34*a*, then catch the vamp 16 immediately below the tab 30, and then pass through the tab 42 of the lining member 36. The lines of stitching 48 form a box-like shape, outlining the tab 30. The ends of the collar 20 are desirably also caught by the stitching 48.

The lines of stitching 48 serves to stitch both the tab 30 of the tongue member 22 and the tab 42 of the lining member 36 to one another, and to join both of these tabs to the aligned portion of the vamp 16 and to the end portion 34*a* of the gore 34. As seen most clearly in FIG. 4 the outward line of stitching 48*a* does not pass through the end portion 34*a* of the gore 34, while the inward line of stitching 48*b* does pass through this end portion.

In a substantially identical manner, the tab 32 of the throat section 26 is joined by a line of stitching 50 to the other end portion 34*b* of the elastic gore 34, to the vamp 16, and to the tab 44 of the lining member 36. The upper edge 35 of the flaired section 28 of the tongue member 22 is then joined by two lines of stitching 52 to the upper edge 53 of the tongue section 38 of the lining member 36. The extension 41 is only glued to the tongue member 22, see FIG. 3.

By virtue of the foregoing construction, the tongue member 22 at its throat section 26 and the lining member 36 at its throat lining section 40 form a tunnel for the elastic gore 34, located transversely of the instep of the wearer's foot and running across the vamp from section 17 to section 19, so that the elastic gore is hidden from external view, and is also kept from contact with the foot of the wearer, when the foot is inserted into the shoe.

The function of the gore 34 is to elastically pull the opposed aligned sections 17, 19 of the vamp toward one another, thereby insuring a snug, yet comfortable fit for the foot of the wearer. When the elastic gore 34 is contracted, that is, in a "relaxed" mode, it wrinkles or shirrs the throat section 26, as seen in FIG. 2, giving the throat section a pleasing appearance. When the gore 34 is stretched or expanded, which is the situation when a foot is placed into the shoe, the shirring or wrinkling becomes less pronounced, as is shown in dot and dash lines in FIG. 4. When the gore 34 is fully expanded, as when a wide foot is placed into the shoe, it substantially disappears from view.

By virtue of the foregoing construction, a shoe is provided which by virtue of the elastic gore, always snugly and comfortably fits the foot of the wearer. This comfort remains, even after the foot of the wearer swells, after several hours of shoe wear. Due to the aforesaid tunnel construction provided for the elastic gore, the gore cannot be seen from the exterior of the shoe, nor is it felt when the foot of the wearer is placed into the shoe. Due to its specific location, the gore yields a pleasant-appearing shirred effect when it is relaxed, and gives a substantially smooth appearance to the throat section 26, when it is fully expanded, resulting in a pleasant-fitting, soft, comfortable shoe.

There is claimed:

1. A construction for a shoe including a vamp, a sole, and a heel, the construction comprising:
   a. a tongue member,
   b. a lining member, the tongue member and the lining member being joined to one another and to the vamp, and forming a continuous tunnel across the throat of the shoe, and
   c. an elastic gore running from one side of the vamp across the throat of the shoe to the other side of the vamp and fixed within the tunnel,
   d. the gore having one face secured to the tongue member along the length of the gore within the tunnel and having its other face secured to the liner member along the length of the gore within the tunnel,
   e. the gore, when relaxed, shirring the tongue member at its mid-section and the lining member.

2. A construction for a shoe as set forth in claim 1, wherein the tongue member has a pair of opposed, protruding tabs, and the lining member has a pair of opposed, protruding tabs, the tabs being stitched in alignment with one another to opposed sides of the vamp and to the ends of the gore.

3. A shoe construction as set forth in claim 2, wherein the tabs of the tongue member are situated at its central portion, and the tabs of the lining member are situated at its forward-most portion.

4. A shoe construction as set forth in claim 2, wherein the tabs and the rearward most portion of the tongue member have a configuration substantially identical to the tabs and the rearward most portion of the lining member.

5. A shoe construction as set forth in claim 2, wherein the lining member is stitched to the tongue member.

6. A shoe construction as set forth in claim 5 wherein the lining member is in addition glued to the tongue member.

7. A shoe construction as set forth in claim 2 wherein the gore is glued to the tongue member and the lining member.

8. A shoe construction as set forth in claim 2 wherein the tongue member has a flaired section, a throat section and a moccasin section, the tabs protruding from the throat section, said sections and tabs being formed of one piece of material.

9. A shoe construction as set forth in claim 8 wherein the lining member and the tabs of the lining member are formed of one piece of material.

* * * * *